United States Patent [19]

Santorineos

[11] Patent Number: 4,478,142

[45] Date of Patent: Oct. 23, 1984

[54] BALLOON-PRINTING APPARATUS WITH SILK-SCREEN

[76] Inventor: Christos Santorineos, 5643 Woodbury Ave, Montreal, Canada, H3T 1S6

[21] Appl. No.: 571,381

[22] Filed: Jan. 13, 1984

[51] Int. Cl.[3] ..... B41F 17/00

[52] U.S. Cl. ..... 101/35; 101/126

[58] Field of Search ..... 101/35, 36, 37, 126

[56] References Cited

U.S. PATENT DOCUMENTS

| | | | |
|---|---|---|---|
| 1,988,662 | 1/1935 | Myers . | |
| 2,016,450 | 10/1935 | Myers . | |
| 2,645,870 | 7/1953 | Smith et al. | 101/40 X |
| 3,224,364 | 12/1965 | Terzuoli . | |
| 3,868,899 | 3/1975 | Nye et al. . | |

FOREIGN PATENT DOCUMENTS

| | | | |
|---|---|---|---|
| 781186 | 3/1968 | Canada . | |
| 1076880 | 5/1980 | Canada . | |
| 1277269 | 9/1968 | Fed. Rep. of Germany | 101/35 |

*Primary Examiner*—Clifford D. Crowder

[57] ABSTRACT

A conveyor chain moves along the periphery of a table. A number of balloon-carrying members are fixed in spaced-apart relationship to the conveyor chain. Each member carries a nipple for engaging the neck of a balloon and a balloon-positioning member movable with respect to the balloon-carrying member between a retracted position and an extended operative position surrounding the neck of the inflated balloon and maintaining the inflated balloon in steady position to be printed by a silk-screen printing press. The balloon-carrying members move in a close path, step by step, through successive stations as follows: stations where deflated balloons can be attached to a nipple; stations where the balloons are inflated; a station where the balloon-positioning member is pushed outwardly to its operative position; a station where the balloon is printed by a silk-screen press; several stations where the ink on the balloon is dried; a station where the positioning member is retracted; and a final station where the inflated balloon is detached from the nipple.

10 Claims, 10 Drawing Figures

BALLOON-PRINTING APPARATUS WITH SILK-SCREEN

FIELD OF THE INVENTION

This invention pertains to machines for printing elastic bodies and, more particularly, to an improved and novel machine for printing inflated balloons, using a silk-screen printing press.

BACKGROUND OF THE INVENTION

Balloon-printing machines are known in which a rotary printing cylinder is used. U.S. Pat. No. 3,868,899 to Norman H. Nye et al. dated Mar. 4, 1975 describes such a machine. However, it is well known such printing cylinders cannot produce on the balloon an image or pattern which has precise contours and in which the printed areas have an ink layer of constant thickness. Therefore, the quality of the image is rather poor. It is known that a good quality image can be printed on a balloon only by using the silk-screen printing process, in which the ink is squeezed through the interstices of a flat woven sheet of silk or the like. Up to now, printing balloons with silk-screen printing press were largely a manual operation and, consequently, very slow and a very low productivity.

OBJECTS OF THE INVENTION

Accordingly, it is the main object of the present invention to provide a balloon-printing machine using a silk-screen printing press and wherein the balloon-inflating, printing, drying and balloon detachment operations are carried out automatically, the operator only having to manually attach successive deflated balloons to the inflating nipples of the machine.

It is another object of the invention to provide a machine of this type which holds the inflated balloons in a steady position for printing by the silk-screen press.

It is another object of the invention to provide means whereby the balloons are inflated at such a rate so as to reduce the chances of unwanted disengagement of the balloon mouth from the inflating nipple.

Other objects and advantages of the machine of the invention will become more apparent as the description proceeds, taken in conjunction with the annexed drawings.

SUMMARY OF THE INVENTION

The machine for printing balloons in accordance with the invention includes an endless conveyor means carrying a plurality of balloon-engaging nipples and a plurality of balloon-positioning members mounted in spaced-apart relationship on the conveyor means with the balloon-positioning members movable between a retracted inoperative position and an extended operative position spaced from the nipple and encircling the neck of the inflated balloon to hold the same steady with respect to the nipple. Power and indexing means are provided for moving the conveyor means step by step in a closed path, there being provided a plurality of spaced-apart functional stations along said path, namely: first stations where the deflated unprinted balloons can be attached to successive nipples; one or more successive inflating stations for inflating the balloon; a station where the balloon-positioning member is extended to its operative position to hold the balloon steady; a printing station where the balloon is applied against a silk-screen printing press; a plurality of drying stations to dry the ink on the inflated and printed balloons; a station where the positioning member is retracted; and a final station where the inflated and dry balloon is detached from its nipple.

BRIEF DESCRIPTION OF THE DRAWINGS

Like reference numerals indicate like parts throughout the drawings.

DETAILED DESCRIPTION OF THE INVENTION

Figure 2:
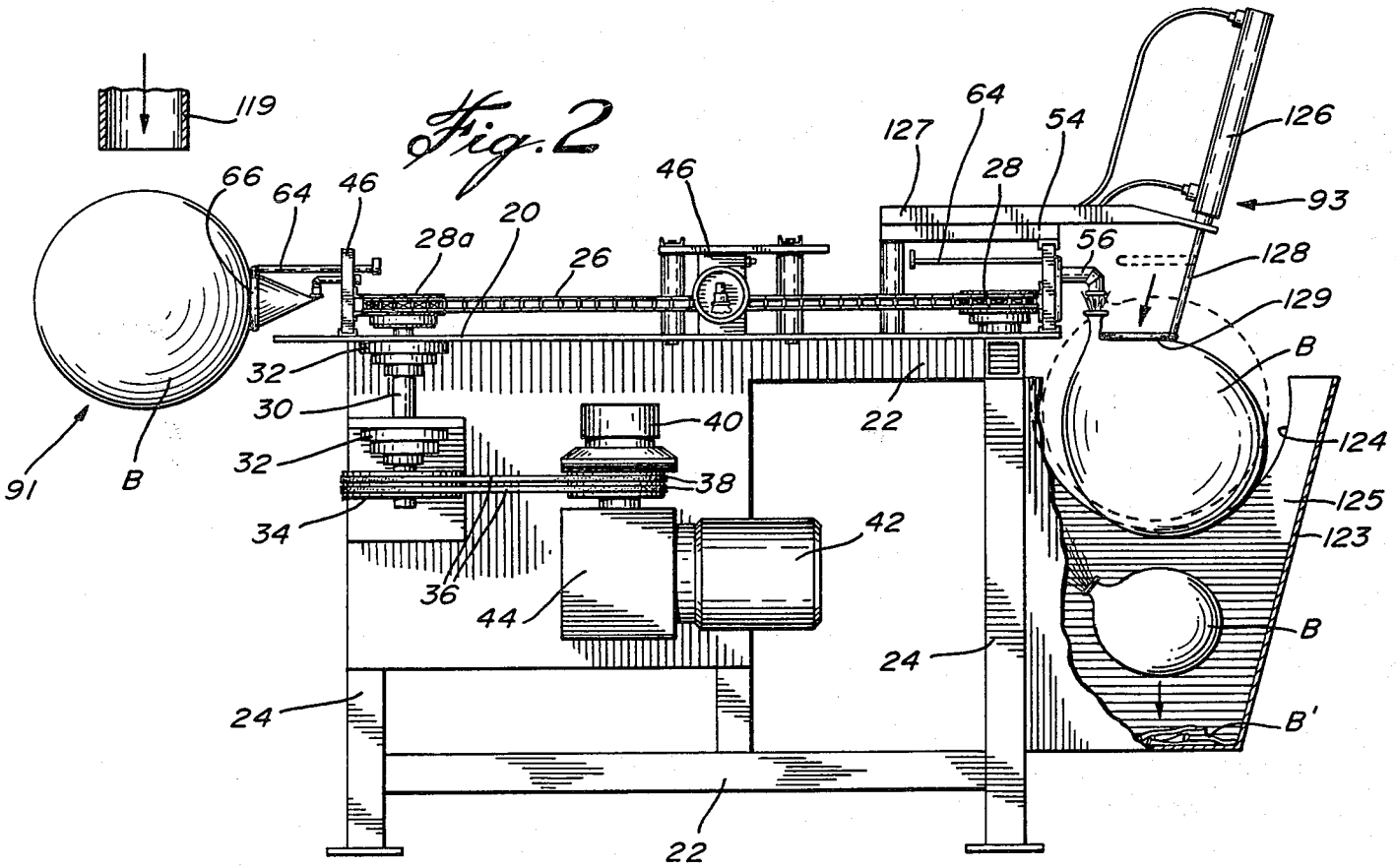
FIG. 2 is an elevational end view of the machine taken from the left end of FIG. 1, the printing station being absent and also showing the unloading station partly in section.

The machine comprises a table 20 supported in horizontal position by a framework including horizontal beams 22 and legs 24. An endless conveyor chain 26 extends in a closed path above and along the perimeter of the table 20. Chain 26 is trained on a series of sprockets 28 disposed at the corners of the table 20 and each mounted for rotation about a vertical axis. All of said sprockets are idle sprockets, except sprocket 28*a* which is a driving sprocket for the conveyor chain 26. The latter is secured, as shown in FIG. 2, to a vertical driving shaft 30 which extends through table 20 below the same. Shaft 30 is journalled in bearings 32 fixed to the table and to its frame. A double pulley 34 is fixed to the lower end of driving shaft 30 and rubber belts 36 are trained on the double pulley 34 and also on the output pulleys 38 of an air-actuated clutch 40, the input shaft of which is driven by an electric motor 42 through a speed-reducing transmission box 44. The air-actuated clutch 40 is part of an indexing mechanism to move the endless conveyor chain 26 step by step or intermittently, so that the chain will stop for a few seconds and then move again. A number of balloon-carrying members 46 are fixed to the conveyor chain 26 at spaced positions along the same.

Figure 4:
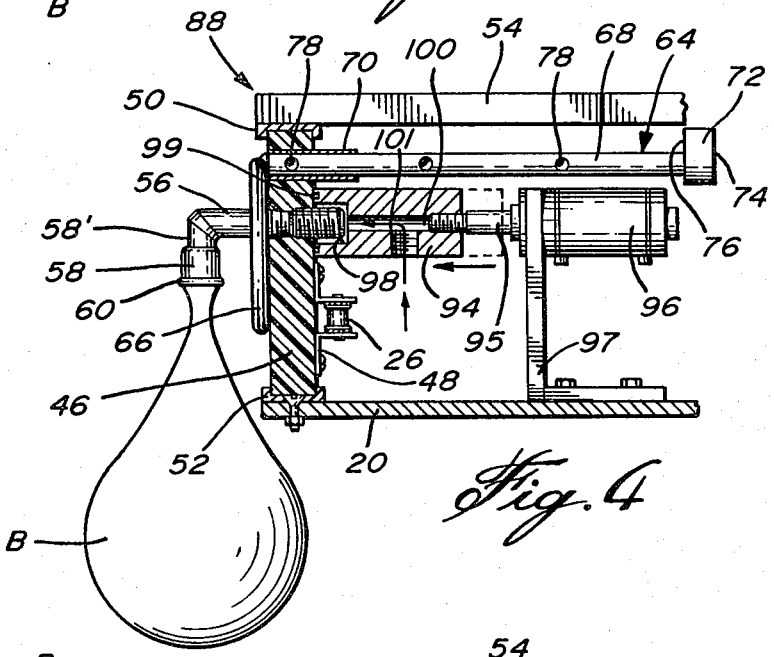
Figure 5:
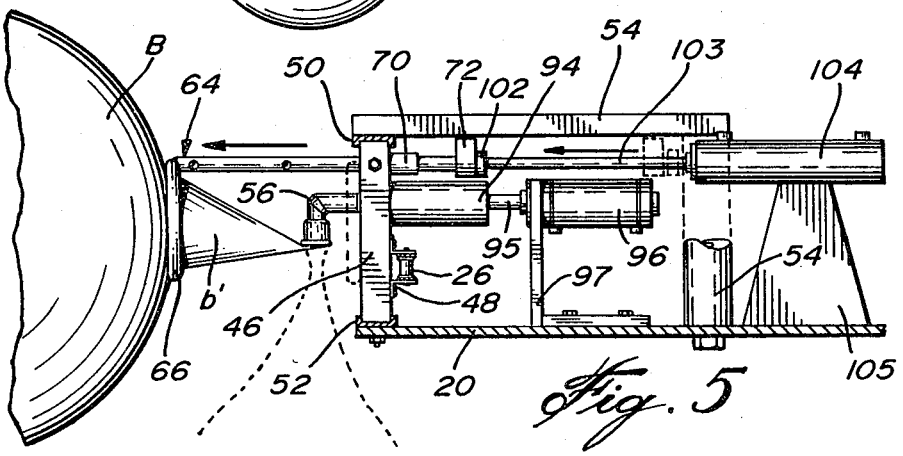

Members 46 are in the form of rectangular plates disposed in a vertical plane to the back of each of which a link of the conveyor chain is secured by a bracket 48, as shown in FIGS. 4 and 5. Each plate or balloon-carrying member 46 is guided for movement along the edge of the table 20 by being slidably engaged in channel-shape top and bottom rails 50 and 52. The bottom rail 52 is fixed directly to the table top 20 all around its perimeter, while the top end 50 is supported over the rail 52 by means of L-shape bracket arms 54 overlying the table 20 and secured to the same. Obviously, the rails 50, 52 need not extend along the entire perimeter of the table 20 but only at those portions where the balloon-carrying members 46 are subjected to a horizontal force transverse to the member 46.

Figure 4A:
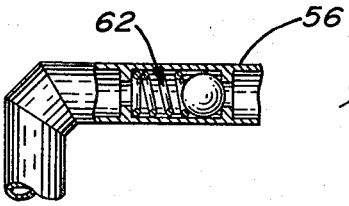
FIG. 4*a* is a longitudinal section of the nipple showing the internal check valve.

Each balloon-carrying member 46 carries a balloon-receiving nipple 56 consisting of an L-shape tube having a horizontal threaded leg through the block-shape member 46, as shown in FIG. 4, and the vertical outer leg 58' of which can be fitted with an adaptor of various diameters in order to receive the mouth of a balloon B of different sizes. The adaptor 58 is provided with a lower rib 60 into which the mouth of the balloon B is manually stretched to retain the non-inflated balloon onto the nipple 56. This nipple is provided in its longitudinal leg with a check valve assembly, as shown at 62 in FIG. 4*a*, to prevent an inflated balloon carried by the nipple from deflating through the nipple. Each balloon-carrying member 46 carries a balloon-positioning member, generally indicated at 64 and which consists of a ring 66 fixed to and depending at right angles from a horizontal push-rod 68 which slidable extends through a bushing 70 fixed within a bore of the balloon-carrying member 46. The push-rod 68 extends horizontally a substantial distance inwardly of the block or balloon-carrying member 46 and is terminated at its free rear end by an enlarged head 72 defining a rear push-face 74 and a front pull-face 76. The balloon-positioning member 64 is movable between a retracted position, as shown in FIG. 4, in which it freely surrounds the nipple 56 and an extended operative position, as shown in FIG. 5, in which the ring 66 is positioned outwardly of the nipple and surrounds the neck of an inflated balloon B to slightly stretch the neck portion b' of the balloon extending between the ring and the nipple 56, so as to steady the balloon with respect to the carrying member 46. At the same time, the neck of the ballon is stretched horizontally away from the downwardly-oriented nipple, so as to make a 90-degree bent at the point where the balloon mouth is attached to the nipple, therefore forming as obstruction which prevents the air pressure within the balloon from causing disengagement of the balloon from the nipple.

Figure 9:
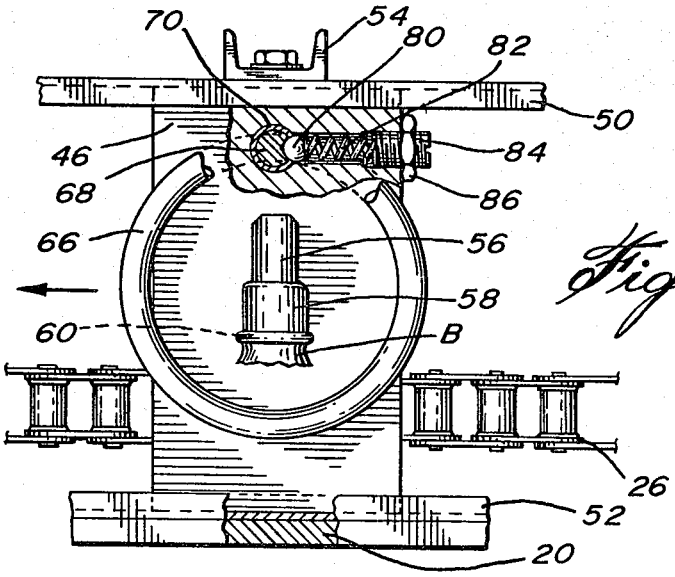
FIG. 9 is an end elevation of one of the balloon-carrying members, partly shown in section and showing also a balloon-positioning member.

To handle balloons of different sizes, the push-rod 68 is preferably provided with, for instance, three longitudinally-spaced locating recesses 78 selectively engageable by a ball 80, as shown in FIG. 9, pressed or biased against the rod by a compression spring 82, the force of which is adjusted by a bolt 84 which is locked by a nut 86. The spring and bolt 84 are arranged within a transverse hole made in the balloon-carrying plate 46. With three locating recesses 78, the ring 66 can be selectively retained in retracted position and in anyone of two operative positions, spaced outwardly from the plate 46 a selected distance to suit balloons of two generally different sizes.

The balloon-carrying members 46, together with the nipples 56 and the balloon-positioning members 64, travel all around the table 20 in a closed path under the action of the conveyor chain 26 driven in intermittent manner by the electric motor 42 through the clutch 40.

Thus, each balloon-carrying member 46 stops at a plurality of stations all around the table in the following manner.

Figure 1:
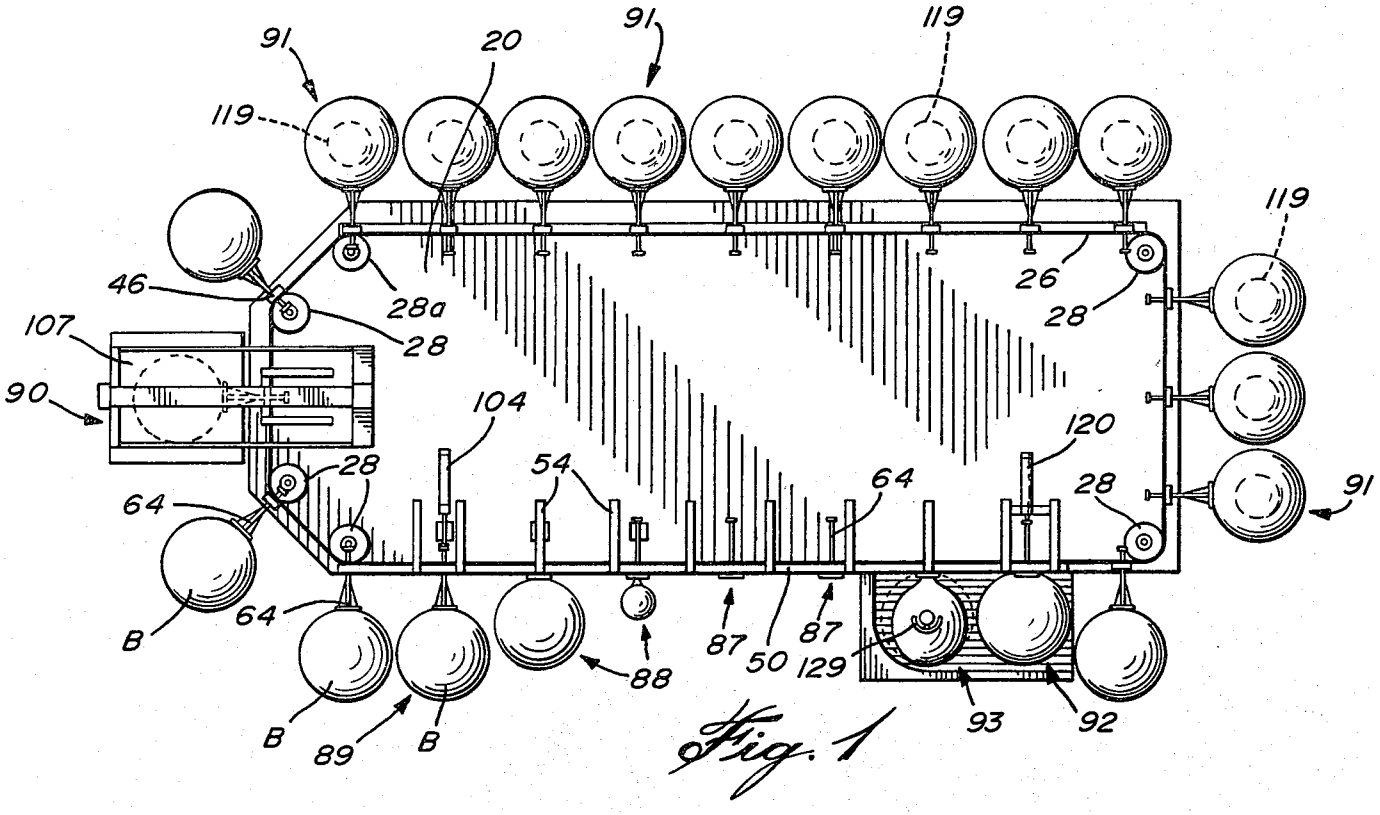
FIG. 1 is a top plan view of the balloon-printing machine.

Referring to FIG. 1, there are two balloon-loading stations 87 followed by two balloon-inflating stations, indicated at 88 and both stations being identical, in turn followed by a balloon-positioning station 89. Then there is a balloon-printing station, generally indicated at 90, followed by several balloon-drying stations, generally indicated at 91. Finally, there is a station 92 where the balloon-positioning member 64 is retracted, or in other words, a balloon-depositioning station, followed by a last station, namely: a balloon-detaching station, indicated at 93.

Figure 3:
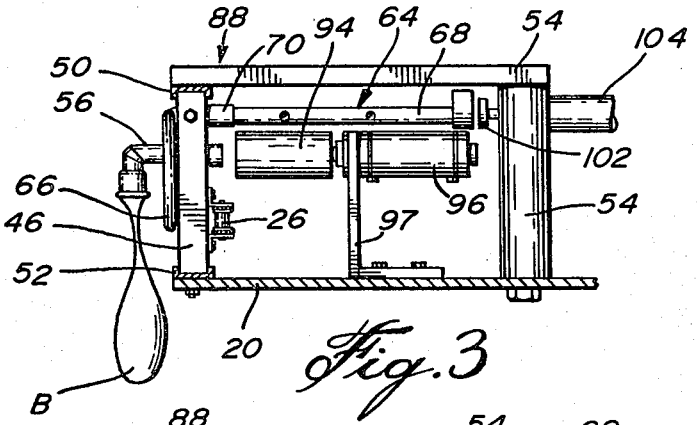
FIGS. 3, 4, and 5 are sequential vertical sections of the balloon-inflating stations and balloon-positioning station.

FIGS. 3 and 4 show anyone of the two identical balloon-inflating stations. At those stations, the inlet end of the nipple 56 carried by the balloon-carrying plate 46, becomes in register with in inflating head 94. Head 94 is in the shape of a cylindrical block secured at its rear end to the piston rod 95 of a double-acting air cylinder 96 mounted in horizontal position above the table 20 by means of a bracket 97 secured to said table. The opposite forward end of the head 94 is provided with a recess 98 for receiving the protruding portion of the nipple 56, while the end face of head 94 has a gasket 99 for making fluid-proof contact with the rear face of the balloon-carrying plate 46 around the nipple 56.

Recess 98 is in communication with a bore 100 made in the head 94 and said bore has a side inlet 101 adapted to be threadedly connected to a connecting nipple of an air supply flexible tube, not shown, for supplying air under pressure to the balloon B attached to the nipple.

The head 94 is movable between a retracted position, shown in FIG. 3, and an extended operative balloon-inflating position, as shown in FIG. 4, in which the gasket 99 makes a seal around the nipple. The head is movable under the action of the air cylinder 96. Control of the operation of the air cylinder is provided by an electric and air circuit, not shown. Suffice it to say that upon particular block 46 arriving at one of the inflating stations, a limit switch will operate an electro valve for operating the air cylinder 96 to advance the inflating head 94 to operative position and, at the same time, open a valve to admit air under pressure to the head 94.

The balloon is inflated at two successive stations, in order to allow sufficient time for balloon inflation so as to be able to reduce the air pressure sufficiently to prevent the detachment of the balloon from the nipple 56 under excessive air pressure. Due to the presence of the check valve 62 within the nipple, the balloon, once inflated, will not deflate as long as it remains attached to the nipple 56. When the balloon-carrying member 46 reaches the balloon-positioning station 89, the head 72 of the push-rod 68 comes in register with the flattened end 102 of the piston rod 103 of a double-acting air cylinder 104. Air cylinder 104 is maintained in horizontal position by means of a bracket 105, and said bracket is adjustably secured to the table 20 for positioning in at least two horizontal positions corresponding to either one of the two operative positions of the ring 66, as previously described, depending on the size of balloon being printed. Thus, when a balloon-carrying member 46 reaches the balloon-positioning station, an electric switch is actuated, thereby actuating the air cylinder 104 which pushes the push-rod 68 outwardly, so that the ring 66 will extend the neck of the inflated balloon and cause said neck to take a horizontal position at right angles to the outlet of the nipple 56, as clearly shown in FIG. 5.

Figure 6:
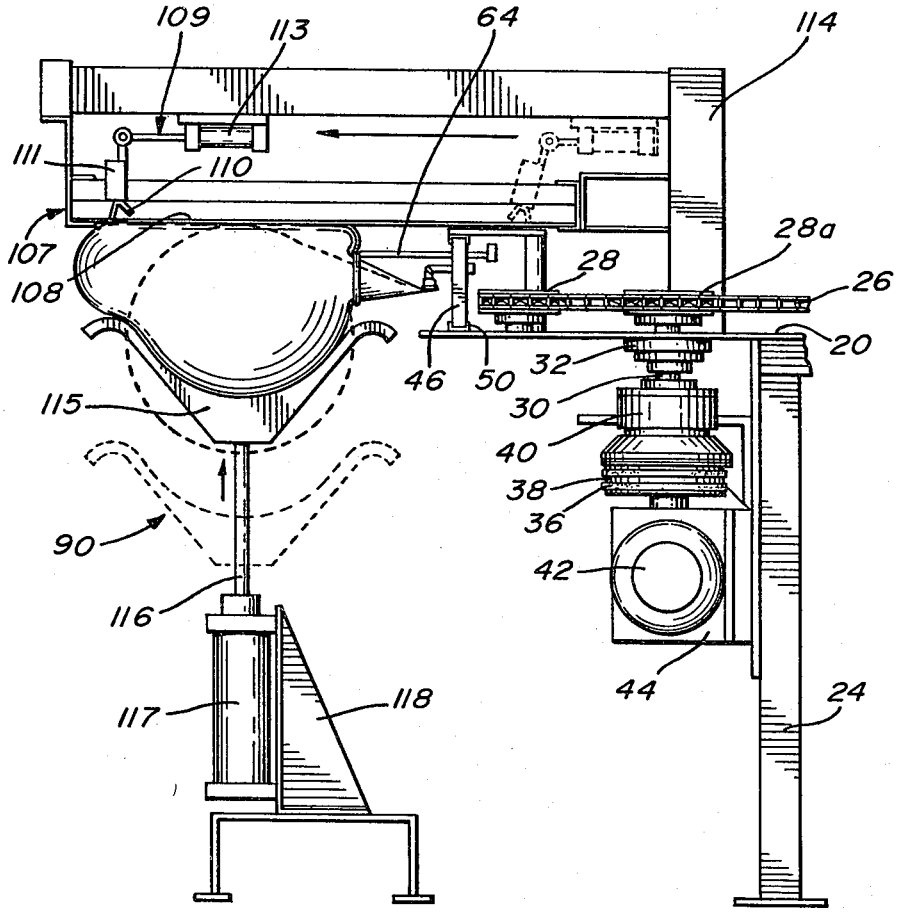
FIG. 6 shows an elevation of the inflated balloon-printing station.

The thus-constrained balloon is then transferred to the printing station. At this station, which as shown in FIG. 6, there is provided a silk-screen printing press, generally indicated at 107. The silk-screen 108 of the printing press is of conventional construction and also the ink-wiping mechanism 109 which includes the ink-wiping rubber blade 110 attached to the rear end of an ink reservoir 111, the assembly being pivoted to a suitable support mechanism and capable of taking an inclined position, as shown in dotted line at the right of FIG. 6, under the action of an air cylinder 113, this inclined position corresponding to the ink-squeezing position when the blade 110 moves along the screen 108, and the upright position, shown in full line, corresponding to the ink-wiping position wherein ink is deposited onto the screen and wiped off to form a uniform layer thereon. A mechanism, not shown, moves the ink wipers back and forth along the screen in conventional manner. The entire printing press is held in overhanging position over the table top by means of L-shape brackets 114 secured to the table. Obviously, means can be provided to adjust both the height and the horizontal position of the printing press assembly 107. The level of the screen is such that, when the balloon arrives at the printing station retained in generally horizontal position by the positioning ring 66, the topmost surface of the balloon is just below the silk-screen 108. At that position, the balloon enters a cradle 115 disposed under the balloon and of generally partially cylindrical shape, said cradle being attached to the upper end of a vertical piston rod 116 of a vertically-held double-acting air cylinder 117 fixed to bracket 118, in turn fixed to the floor or the like in adjustable position.

The cradle 115, upon the balloon reaching the printing station, moves from its lowermost position, shown in dotted line in FIG. 6, to an uppermost position in which it presses the balloon against the silk-screen 108 to cause printing of the balloon. During this movement, the balloon surface is deformed flat against the silk-screen, as clearly shown in FIG. 6. The cradle 115 immediately retracts to its lowermost position and the balloon assumes its normal round shape and falls a little under gravity to clear the silk-screen. The conveyor chain then moves the balloon through the drying stations 91.

Figure 7:
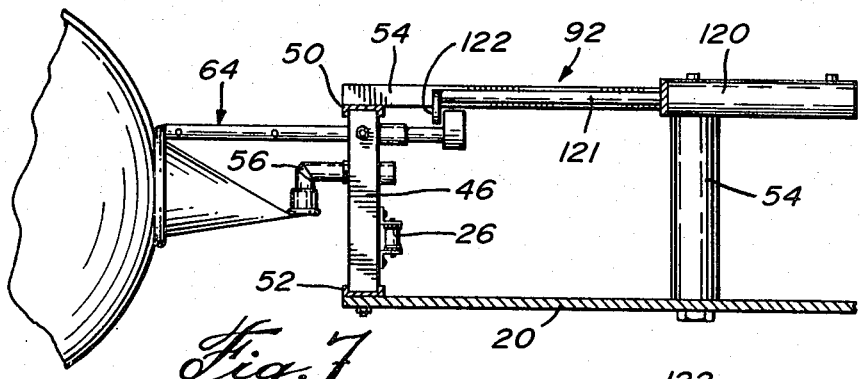
FIGS. 7 and 8 are vertical sections of the station where the positioning device is retracted to inoperative position.
Figure 8:
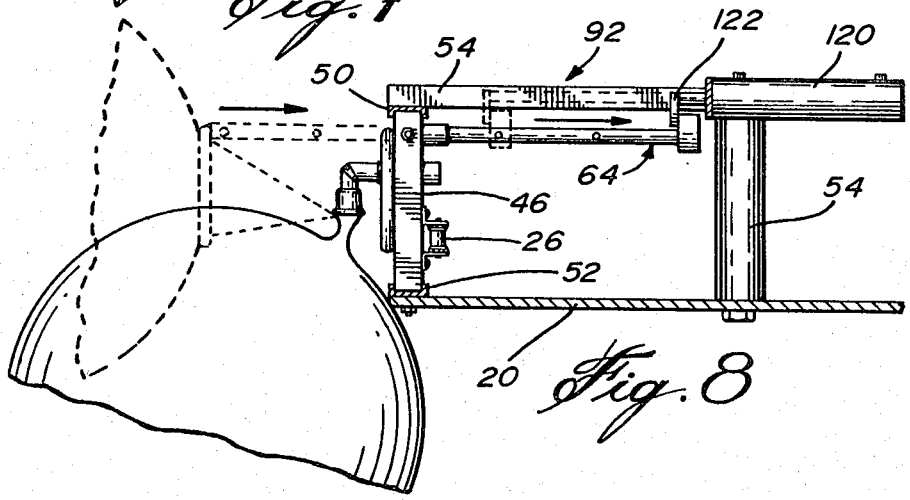

Preferably, there is a number of such stations and, at each one of them, an overlying flexible air duct 119 opens just on top of the balloon at each station to supply preferably hot air onto the printed surface of the balloon. Each balloon then arrives successively at the balloon-depositioning station 92 and more particularly shown in FIGS. 7 and 8.

A double-acting air cylinder 120 is secured in horizontal position at station 92 and the piston rod 121 has an enlarged end 122 so positioned so as to overlap the pull face 76 of head 72 of the balloon-positioning member 64 when the latter comes in alignment with the piston rod 121, the latter being in extended position. The air cylinder 120 is actuated so as to retract the piston rod 121 and thereby retract the balloon-positioning member 64 to the retracted position shown in FIG. 8. The balloon B is then free and takes a downward position under gravity, being still retained on the adapter 58 of the nipple 56. The balloon then moves to the balloon-detaching station 93, which is shown in FIG. 2. At that station, there is provided an open top container 123 fixed to the frame of the machine on the side thereof, said container having a cut-out portion 124 in its sidewall 125 nearer the balloon-depositioning station 92. This cutout is for the passage of the balloons as they come from station 92 and enter the container 123. A double-acting air cylinder 126 is secured to table 20 in a vertical plane in vertical register with the open top container 123 and being downwardly inwardly inclined towards the table, as shown in FIG. 2. The air cylinder 126 is rigidly secured to the table by an L-shape barcket 127 secured to said table. The piston rod 128 of the air cylinder 126 carries at its outer end a ring 129 arranged in a horizontal plane. When a balloon B arrives at station 93 within container 123, the air cylinder 126 is operated, so that the ring 129, which is initially in retracted position, as shown is dotted line in FIG. 2, moves downwardly and inwardly within the container to push on the inflated balloon B and detach it from the adapter 58 of the nipple 56. The balloon is forcibly ejected within the container where it deflates and eventually falls within the bottom of the container 123. During deflation, even if the balloon moves in any direction, it is trapped within the container and will not escape from the latter. The printed and deflated balloons pile up within the container 123, as shown at B' in FIG. 2.

The single operator for the machine may sit in front of the two balloon-loading stations 87 to properly attach successive unprinted balloons to the nipple adapters 58 at that station. Because the nipples 56 downwardly extend, it is easy for the operator to attach a balloon thereto and also the balloon tends to move downwardly within the container 123 when detached from the nipple by the air cylinder 126.

What I claim is:

1. An apparatus for printing balloons comprising a supporting frame, an endless conveyor means movably supported by said frame, a plurality of balloon neck-receiving nipples and a like number of balloon-positioning members carried by said conveyor means in spaced-apart position therealong, said balloon-positioning members including a ring movable with respect to said nipple between a retracted position and an extended outward position, said ring adapted to surround the neck of a balloon attached to said nipple and stretch said neck when said ring is in extended position, so as to steady said balloon with respect to said nipple, means for moving said conveyor means step by step in a closed path with said nipples and balloon-positioning members successively stopping at a plurality of spaced-apart functional station, a first one of said stations allowing attaching a deflated balloon to said nipple, means at a second station to inflate the balloon, means at a third station to extend the balloon-positioning member to operative position, a silk-screen printing press mounted at a fourth station and means to cause the inflated balloon to be printed by said press, means at succeeding fifth stations to cause the drying of the ink printed on the balloon, means at a sixth station to retract the balloon-positioning member and means at a seventh station to detach the printed balloon from said nipple.

2. An apparatus as defined in claim 1, wherein the ring of said balloon-positioning member spacedly surrounds the nipple when in retracted position, said nipple having an outer leg for insertion into the mouth of a balloon, said outer leg lying in a plane parallel to the plane of said ring, the latter, when in extended position, being spaced outwardly from said leg and causing the neck of the balloon attached to said nipple to make a right angular bend at said nipple.

3. An apparatus as defined in claim 2, wherein said conveyor means include spaced plate members, each carrying a nipple and a balloon-positioning member, the latter including a straight rod slidably mounted and carried by said plate member, said means for extending said balloon-positioning members including a first ram member mounted on said frame at said second station and acting on said rod to push the same outwardly of said plate member, and a second ram member mounted at said sixth station engageable with said rod to pull the same inwardly towards said plate member.

4. An apparatus as claimed in claim 3, wherein said means to inflate said balloon includes at said balloon-inflating station an inflating head having a recess at a free end in permanent communication with a source of air under pressure, said head carried by a ram, said ram actuable to press said head against said plate member with the nipple engaging within said recess, said head retractable under the action of said last-named ram to clear said nipple and plate member.

5. An apparatus as claimed in claim 4, further including means at said fourth station to cause relative movement between said balloon and silk-screen, in order to flatten the inflated balloon against said silk-screen for printing of said balloon.

6. An apparatus as claimed in claim 5, wherein said printing screen is carried by said frame in a position spacedly overlying an inflated balloon positioned at said fourth station and said last-named means includes a cradle engageable underneath the balloon at said station, and means to move said cradle upwardly towards said silk-screen to engage the bottom of said balloon and press it against said silk-screen.

7. An apparatus as defined in claim 5, wherein each nipple houses a check valve to prevent deflation of an inflated balloon attached to said nipple.

8. An apparatus as claimed in claim 7, wherein said drying means includes tubes opening adjacent to and over the printed area of said balloon located at said fifth stations, said tubes adapted to be connected to a source of hot air.

9. An apparatus as claimed in claim 7, wherein said means to detach said balloon from the nipple at said seventh station includes a ram mounted on said frame and having a piston rod engageable with a balloon at said station and operable to push on the same to detach said balloon from its nipple.

10. An apparatus as claimed in claim 9, further including an open top container at said last-named station to receive a balloon detached from the nipple and to constrain the same during its deflation.

* * * * *